US008381475B2

(12) United States Patent
Carbines

(10) Patent No.: US 8,381,475 B2
(45) Date of Patent: Feb. 26, 2013

(54) FIXING SYSTEM FOR CLADDING

(75) Inventor: Richard James Carbines, Auckland (NZ)

(73) Assignee: Jenkin Timber Limited, Auckland (NZ)

( * ) Notice: Subject to any disclaimer, the term of this patent is extended or adjusted under 35 U.S.C. 154(b) by 0 days.

(21) Appl. No.: 12/439,974

(22) PCT Filed: Sep. 5, 2007

(86) PCT No.: PCT/NZ2007/000255

§ 371 (c)(1),
(2), (4) Date: Jun. 4, 2009

(87) PCT Pub. No.: WO2008/030114

PCT Pub. Date: Mar. 13, 2008

(65) Prior Publication Data

US 2010/0205886 A1 Aug. 19, 2010

(30) Foreign Application Priority Data

Sep. 5, 2006 (NZ) ..... 549708

(51) Int. Cl.
*E04B 1/38* (2006.01)

(52) U.S. Cl. ..... 52/546; 52/489.1; 52/553; 52/543

(58) Field of Classification Search ..... 52/518, 52/553, 546, 520, 519, 524, 543, 560, 478, 52/483.1, 489.1, 551, 536, 539
See application file for complete search history.

(56) References Cited

U.S. PATENT DOCUMENTS 2,820,257 A * 1/1958 Newton ..... 52/530
3,236,932 A * 2/1966 Grigas et al. ..... 52/543
3,261,136 A * 7/1966 Abner et al. ..... 52/471
3,866,378 A * 2/1975 Kessler ..... 52/519
5,029,425 A 7/1991 Bogataj
5,323,581 A * 6/1994 Jakel ..... 52/519

(Continued)

FOREIGN PATENT DOCUMENTS

AU 197841506 5/1980
JP 06049953 A * 2/1994

(Continued)

*Primary Examiner* — Robert Canfield
*Assistant Examiner* — Babajide Demuren
(74) *Attorney, Agent, or Firm* — Dann, Dorfman, Herrell and Skillman, P.C.

(57) ABSTRACT

A fixing system (20) for securing cladding boards (28) to the framing (26) of a building in a partially overlapping relationship, each board (28) having front and rear faces with a recess (42) being provided in and along the rear face. The fixing system (20) comprises a plurality of fixing devices (30), supported by the framing (26), that are spaced apart relative to one another and arranged in rows, each row of fixing devices (30) being arranged to support a board or row of boards (28) and each fixing device (30) having an engagement portion (40) that is arranged to engage with a section of the recess (42) of a board (28) to, in co-operation with a number of other fixing devices (30) of that row also engaging with a section of the recess (42), support the board (28) in place on the framing (26). Also, the fixing system comprises a plurality of fixing components (44) that are arranged to extend through the front face of each board (28) within the overlapping region of adjacent boards and into the framing (26) to secure each board (28) to the framing (26) in co-operation with the fixing devices (30).

27 Claims, 12 Drawing Sheets

U.S. PATENT DOCUMENTS

| | | | | |
|---|---|---|---|---|
| 5,349,802 | A * | 9/1994 | Kariniemi | 52/543 |
| 6,044,609 | A * | 4/2000 | Kim | 52/551 |
| 6,122,876 | A * | 9/2000 | Bado et al. | 52/518 |
| 6,223,492 | B1 * | 5/2001 | Barnhart et al. | 52/551 |
| 2003/0014936 | A1 | 1/2003 | Watanabe | |

FOREIGN PATENT DOCUMENTS

| | | |
|---|---|---|
| NZ | 206762 | 8/1987 |
| NZ | 282745 | 11/1997 |
| WO | 01/38668 | 5/2001 |

* cited by examiner

FIXING SYSTEM FOR CLADDING

FIELD OF THE INVENTION

The present invention relates to a fixing system for cladding. In particular, although not exclusively, the fixing system may be utilised to secure weatherboards to the walls or framing of buildings. The fixing system also has applications in relation to fencing, screens, and roofing.

BACKGROUND TO THE INVENTION

There are numerous weatherboard designs on the market. The most important feature of a weatherboard design is its cross-sectional profile. This profile dictates the way in which the weatherboards should be installed and the overall appearance of the weatherboard cladding after installation. Commonly, weatherboards are designed to be installed in an overlapping relationship with each other and can be fixed horizontally, vertically or on an angle. Further, some weatherboard designs include grooves that, when installed, cooperate with the grooves of overlapping like weatherboards to provide anti-capillary channels. Such channels prevent moisture from getting in behind the weatherboards and causing damage.

FIGS. 1 and 2 show cross-sectional and front views of a known weatherboard design 10. The rear surface 11 of the weatherboard 10 has a sloped portion 12 that is arranged to abut the framing 16 of a building when installed and this enables like weatherboards to be installed in a partial overlapping relationship with each other as shown in FIG. 3. Weatherboards having this design are also provided with wide grooves 13 and 14 along the front 15 and rear 11 surfaces respectively. When such weatherboard cladding is installed, the grooves of each weatherboard cooperate with the grooves of overlapping weatherboards to create anti-capillary channels 17 shown in FIG. 3.

During installation, the weatherboards shown in FIGS. 1-3 are typically fixed to the framing 16 one at a time from the bottom up such that the weatherboards are parallel and have an even overlap up the framing. One method of aligning the weatherboards is to ascertain the required level and then rest the next weatherboard to be installed on a line of nails partially nailed in, which are removed once the weatherboard has been nailed into place.

Referring to FIG. 4, it has become increasingly common for cavity battens 19 to be provided between the framing 16 and weatherboards 10. The battens 19 create cavities between the framing 16 or wall of the building and the weatherboards 10 and these cavities provide a drainage path for water and/or moisture that may penetrate in behind the weatherboards. The use of cavity battens is particularly desirable in coastal properties or buildings that are situated in exposed areas that have harsh weather conditions. The cavity battens are used to form drainage channels and the increased drainage allowed by the cavities reduces the likelihood of water or moisture penetrating the framing cavity, the cause of internal structural and interior lining rotting and decay.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved fixing system fox cladding, or to at least provide the public with a useful choice.

SUMMARY OF THE INVENTION

In a first aspect, the present invention broadly consists in a fixing system for securing cladding boards to the framing of a building in a partially overlapping relationship, each board having front and rear faces with a recess being provided in and along the rear face, the fixing system comprising: a plurality of fixing devices, supported by the framing, that are spaced apart relative to one another and arranged in rows, each row of fixing devices being arranged to support a board or row of boards and each fixing device having an engagement portion that is arranged to engage with a section of the recess of a board to, in co-operation with a number of other fixing devices of that row also engaging with a section of the recess, support the board in place on the framing; and a plurality of fixing components that are arranged to extend through the front face of each board within the overlapping region of adjacent boards and into the framing to secure each board to the framing in co-operation with the fixing devices.

In one form, the fixing devices are provided in integral strips that are secured to the framing for receiving the boards, each strip being provided with a number of integral fixing devices spaced apart along its length, and the strips being spaced apart and aligned on the framing in a vertical orientation relative to each other to provide rows of fixing devices on the framing for supporting rows of boards. Preferably, the fixing devices are spaced apart along the length of the strips by a uniform predetermined distance that is calculated based on the height of the boards and a uniform desired board overlap distance so that each row of boards has a corresponding row of fixing devices:

In another form, the fixing devices are individually attached directly to the framing in a spaced apart arrangement vertically and horizontally with respect to each other on the framing to form rows of fixing devices on the framing for supporting rows of boards.

In yet another form, the fixing devices are provided on battens that are secured to the framing for receiving the boards, each batten being provided with a number of fixing devices spaced apart along its length, and the battens being spaced apart and aligned on the framing in a vertical orientation relative to each other to provide rows of fixing devices on the framing for supporting rows of boards.

Preferably, the fixing devices are spaced apart along the length of the battens by a uniform predetermined distance that is calculated based on the height of the boards and a uniform desired board overlap distance so that each row of boards has a corresponding row of fixing devices. In one form, the fixing devices are integrally formed with the battens. In another form, the fixing devices are individually attached directly to the battens. In yet another form, the fixing devices are integrally formed in integral strips that are fixed to the battens.

Preferably, the battens each comprise an elongate base member that is attached along its length to a corresponding top plate, the top plate being provided with a number of integral fixing devices spaced apart along its length.

Preferably, the engagement portions of the fixing devices are shaped to engage or co-operate with a complementary recess in the rear face of the boards to thereby act to, in co-operation with a number of other fixing devices of that row also engaging with the recess, support the board in place on the framing.

In one form, each fixing device is a wedge-shaped component having an engagement portion for engaging with the recess of a board. Preferably, each fixing device has a substantially wedge-shaped cross-sectional profile formed by a base end from which a rear face and a front face extend, the front face being inclined relative to the rear face such that the front and rear faces meet to form a pointed top-end opposite the base end and wherein the front face is designed to abut a rear face of the board and has an engagement portion that protrudes from the front face at or toward the base end for engaging with a recess in the rear face of the board. More preferably, the engagement portion of the fixing device is a tapered protrusion the end-point of which is arranged to extend upward and outward at an angle from the front face of the fixing device, the recess of the boards having a complementary inclined surface for receiving the tapered protrusions in a hook-like engagement relationship to enable the boards to be supported on the firming by the fixing devices.

In an alternative form, each fixing device is a bracket-type component having an engagement portion for engaging with the recess of a board. By way of example, each fixing device has a substantially L-shaped cross-sectional profile formed by a base portion that is arranged to extend outwardly relative to the framing and an engagement portion that extends upwardly from the base portion and which terminates with a hooked-end edge that bends toward the framing, the recess of the boards being arranged to receive the engagement portion of the fixing device and having a complementary inclined surface for receiving the hooked end edge of the engagement portion in a hook-like engagement relationship to enable the boards to be supported on the framing by the fixing devices. Alternatively, each fixing device has a substantially U-shaped cross-sectional profile formed by: a rear portion being arranged for securing directly or indirectly to the framing; a base portion extending outwardly from the bottom of the rear portion; and a front engagement portion that extends upwardly from the base portion and which terminates with a hooked-end edge that bends toward the rear portion, the recess of the boards being arranged to receive the engagement portion of the fixing device and having a complementary inclined surface for receiving the hooked end edge of the engagement portion in a hook-like engagement relationship to enable the boards to be supported on the framing by the fixing devices. Preferably, the portions of each fixing device are integrally formed with each other.

Preferably, each board is provided with grooves along its front and rear faces and is arranged to abut another board in a partially overlapping relationship when installed on the framing such that the grooves of the front and rear faces co-operate to form a channel, the fixing components being arranged to extend through the front face of each board and into the framing within the overlapping region of adjacent boards but under the respective channels to secure each board to the framing in co-operation with the fixing devices.

Preferably, the fixing components are arranged to extend through the front face of each board within the overlapping region and into the framing behind each board such that the fixing components are concealed underneath the overlapping portion of an adjacent board.

Preferably, the fixing components are selected from the following: nails, screws, or staples.

In a second aspect, the present invention broadly consists in a fixing device for holding cladding boards in place on framing, each board having front and rear faces, a recess being provided in and along the rear face, and being arranged to be installed on the framing in a partially overlapping relationship with other like boards, the fixing device being arranged to co-operate with a number of like fixing devices such that the fixing devices are supported by the framing and are spaced apart relative to each other and arranged in rows, the fixing device having an engagement portion for engaging with a section of the recess of a board to, in co-operation with the other fixing devices of that row also engaging with a section of the recess, hold the board in place on the framing.

Preferably, the fixing device is arranged to be securely attached directly or indirectly to the framing.

In one form, the fixing device is a wedge-shaped component having an engagement portion for engaging with the recess of a board. Preferably, the fixing device has a substantially wedge-shaped cross-sectional profile formed by a base end from which a rear face and a front face extend, the front face being inclined relative to the rear face such that the front and rear faces meet to form a pointed top-end opposite the base end and wherein the front face is designed to abut a rear face of the board and has an engagement portion that protrudes from the front face at or toward the base end for engaging with a recess in the rear face of the board. More preferably, the engagement portion is a tapered protrusion the end-point of which is arranged to extend upward and outward at an angle from the front face of the fixing device, the recess of the boards having a complementary inclined surface for receiving the tapered protrusions in a hook-like engagement relationship to enable the boards to be held on the framing by the fixing devices.

In an alternative form, the fixing device is a bracket-type component having an engagement portion for engaging with the recess of a board. By way of example, the fixing device has a substantially L-shaped cross-sectional profile formed by a base portion that is arranged to extend outwardly relative to the framing and an engagement portion that extends upwardly from the base portion and which terminates with a hooked-end edge that bends toward the framing, the recess of the boards being arranged to receive the engagement portion of the fixing device and having a complementary inclined surface for receiving the hooked end edge of the engagement portion in a hook-like engagement relationship to enable the boards to be held on the framing by the fixing devices. Alternatively, the fixing device has a substantially U-shaped cross-sectional profile formed by: a rear portion being arranged for securing directly or indirectly to the framing; a base portion extending outwardly from the bottom of the rear portion; and a front engagement portion that extends upwardly from the base portion and which terminates with a hooked-end edge that bends toward the rear portion, the recess of the boards being arranged to receive the engagement portion of the fixing device and having a complementary inclined surface for receiving the hooked end edge of the engagement portion in a hook-like engagement relationship to enable the boards to be supported on the framing by the fixing devices. Preferably, the portions of each fixing device are integrally formed with each other.

In a third aspect, the present invention broadly consists in a cavity batten for holding cladding boards up against framing, the batten being securable to the framing and being arranged to, in co-operation with a number of like battens, receive and retain boards thereon, each board having front and rear faces and being arranged to be fixed to the battens in a partially overlapping relationship relative to one another, a recess being provided in and along the rear face of each board, the batten comprising: an elongate base member that is arranged to be secured to the framing; and a number of fixing devices spaced apart along the length of the base member that form rows of fixing devices when a number of battens are secured to the framing, each fixing device having an engagement portion that is arranged to engage in a section of the recess of a board to, in co-operation with a number of other fixing devices of that row also engaging with a section of the recess, hold the board in place against the framing.

Preferably, the fixing devices are spaced apart along the length of the battens by a uniform predetermined distance that is calculated based on the height of the boards and a uniform desired board overlap distance so that each row of boards has a corresponding row of fixing devices.

In one form, the fixing devices are integrally formed with the base member of the batten. In another form, the fixing devices are individually attached directly to the base member of the batten. In yet another form, the fixing devices are integrally formed in integral strips that are fixed to the base member of the batten.

Preferably, the batten further comprises a top plate that is attached to the base member along its length, the top plate being provided with a number of integral fixing devices spaced apart along its length.

In one form, each fixing device is a wedge-shaped component having an engagement portion for engaging with the recess of a board. Preferably, each fixing device has a substantially wedge-shaped cross-sectional profile formed by a base end from which a rear face and a front face extend, the front face being inclined relative to the rear face such that the front and rear faces meet to form a pointed top-end opposite the base end and wherein the front face is designed to abut a rear face of the board and has an engagement portion that protrudes from the front face at or toward the base end for engaging with a recess in the rear face of the board. More preferably, the engagement portion of each fixing device is a tapered protrusion the end-point of which is arranged to extend upward and outward at an angle from the front face of the fixing device, the recess of the boards having a complementary inclined surface for receiving the tapered protrusions in a hook-like engagement relationship to enable the boards to be held on the framing by the fixing devices.

In another form, each fixing device is a bracket-type component having an engagement portion for engaging with the recess of a board. By way of example, each fixing device has a substantially L-shaped cross-sectional profile formed by a base portion that is arranged to extend outwardly relative to the framing and an engagement portion that extends upwardly from the base portion and which terminates with a hooked-end edge that bends toward the batten, the recess of the boards being arranged to receive the engagement portion of the fixing device and having a complementary inclined surface for receiving the hooked end edge of the engagement portion in a hook-like engagement relationship to enable the boards to be held on the framing by the fixing devices. Alternatively, each fixing device has a substantially U-shaped cross-sectional profile formed by: a rear portion being arranged for securing directly or indirectly to the framing a base portion extending outwardly from the bottom of the rear portion; and a front engagement portion that extends upwardly from the base portion and which terminates with a hooked-end edge that bends toward the rear portion, the recess of the boards being arranged to receive the engagement portion of the fixing device and having a complementary inclined surface for receiving the hooked end edge of the engagement portion in a hook-like engagement relationship to enable the boards to be supported on the framing by the fixing devices. Preferably, the portions of each fixing device are integrally formed with each other.

In a fourth aspect, the present invention broadly consists in a fixing strip for holding cladding boards up against framing, the strip being securable to the framing and being arranged to, in co-operation with a number of like strips, receive and retain boards thereon, each board having front and rear faces and being arranged to be fixed to the framing in a partially overlapping relationship relative to one another, a recess being provided in and along the rear face of each board, the strip comprising: an elongate base member that is arranged to be secured to the framing; and a number of integral fixing devices spaced apart along the length of the base member that form rows of fixing devices when a number of strips are secured to the framing, each fixing device having an engagement portion that is arranged to engage in a section of the recess of a board to, in co-operation with a number of other fixing devices of that row also engaging with a section of the recess, hold the board in place against the framing.

Preferably, the fixing devices are spaced apart along the length of the strips by a uniform predetermined distance that is calculated based on the height of the boards and a uniform desired board overlap distance so that each row of boards has a corresponding row of fixing devices.

In one form, each fixing device is a wedge-shaped component having an engagement portion for engaging with the recess of a board. Preferably, each fixing device has a substantially wedge-shaped cross-sectional profile formed by a base end from which a rear face and a front face extend, the front face being inclined relative to the rear face such that the front, and rear faces meet to form a pointed top-end opposite the base end and wherein the front face is designed to abut a rear face of the board and has an engagement portion that protrudes from the front face at or toward the base end for engaging with a recess in the rear face of the board. More preferably, the engagement portion of each fixing device is a tapered protrusion the end-point of which is arranged to extend upward and outward at an angle from the front face of the fixing device, the recess of the boards having a complementary inclined surface for receiving the tapered protrusions in a hook-like engagement relationship to enable the boards to be held on the framing by the fixing devices.

In an alternative form, each fixing device is a bracket-type component having an engagement portion for engaging with the recess of a board. By way of example, each fixing device has a substantially L-shaped cross-sectional profile formed by a base portion that is arranged to extend outwardly relative to the framing and an engagement portion that extends upwardly from the base portion and which terminates with a hooked-end edge that bends toward the strip, the recess of the boards being arranged to receive the engagement portion of the fixing device and having a complementary inclined surface for receiving the hooked end edge of the engagement portion in a hook-like engagement relationship to enable the boards to be held on the framing by the fixing devices. Alternatively, each fixing device has a substantially U-shaped cross-sectional profile formed by: a rear portion being arranged for securing directly or indirectly to the framing; a base portion extending outwardly from the bottom of the rear portion; and a front engagement portion that extends upwardly from the base portion and which terminates with a hooked-end edge that bends toward the rear portion, the recess of the boards being arranged to receive the engagement portion of the fixing device and having a complementary inclined surface for receiving the hooked end edge of the engagement portion in a hook-like engagement relationship to enable the boards to be supported on the framing by the fixing devices.

In a fifth aspect, the present invention broadly consists in a cladding board for securing to framing in a partially overlapping relationship relative to other like boards, the board comprising front and rear faces, the rear face being provided with a recess in and along its length that is arranged to engage with a number of complementary spaced apart fixing devices supported by the framing, the fixing devices being arranged in rows on the framing, a number of fixing devices of a row engaging with sections of the recess of a board to support the board up against the framing.

Preferably, the recess is shaped to engage with engagement portions of the fixing devices to enable the board to be supported in place on the framing by the fixing devices.

Preferably, the recess comprises an angled upper surface that together with the rear face of the board forms a tapered upper edge that points downwardly and outwardly relative to the rear face for engaging in a hook-like engagement relationship with the fixing devices.

Preferably, the recess has a cross-sectional profile comprising: a lower surface extending substantially perpendicularly into the board from and relative to the rear face of the board, a back surface extending upwardly from the lower surface, and an angled upper surface extending downwardly back to the rear face of the board from the back surface.

Preferably, the board further comprises grooves along its front and rear faces and is arranged to abut another like board in a partially overlapping relationship when installed on the framing such that the grooves of the front and rear faces co-operate to form a channel.

In a sixth aspect, the present invention broadly consists in a method of installing cladding boards onto the framing of a building in a partially overlapping relationship such that adjacent boards have an overlapping region, each board having front and rear faces with a recess being provided in and along the rear face, the method comprising the steps of: (a) securing rows of spaced-apart fixing devices to the framing, each row of fixing devices being arranged to support a board or row of boards and each fixing device having an engagement portion that is arranged to engage with a section of the recess of a board to, in co-operation with a number of other fixing devices of that row also engaging with a section of the recess, support the board in place on the framing, the vertical distance between the rows of fixing devices determining the overlapping region between adjacent boards; (b) engaging a first board with the lower-most row of fixing devices such that the engagement portions of a number of fixing devices of that row engage into the recess of the rear face of the first board to support and hold it in place such that at least a portion of the rear face abuts the framing, (c) driving a number of fixing components through the front face of the first board and into the framing along the length of the board within the overlapping region to secure the board in place on the framing; and (d) repeating steps (b) and (c) for second and subsequent boards in relation to the next rows of fixing devices to progressively clad the framing with boards from the bottom up.

In one form, step (a) comprises providing a number of battens, each batten having a number of fixing devices uniformly spaced apart along its length, and securing the battens in a spaced apart relationship and in a vertical orientation on the framing such that the fixing devices of the battens are aligned to form the rows of fixing devices.

In another form, step (a) comprises securing individual fixing components directly to the framing in a spaced apart arrangement vertically and horizontally with respect to each other to form the rows of fixing devices.

In yet another form, step (a) comprises providing a number of fixing strips, each fixing strip having a number of integral fixing devices spaced apart along its length, and securing the fixing strips in a spaced apart relationship and in a vertical orientation on the framing such that the fixing devices of the fixing strips are aligned to form the rows of fixing devices.

Preferably, step (c) comprises driving fixing components selected from the following: nails, screws, or staples.

The term "board" as used in this specification and claims is intended to cover any type, shape, or profile of cladding board, sheathing, or siding, including, by way of example only, weatherboards, bevel-backed boards and sidings, and rusticated boards and sidings.

The term "framing" as used in this specification and claims is intended to cover any surface that is to be clad with boards, including any framing components such as studs or struts, and any type of sheet backing surface or the like, whether in the context of walls, fencing, screens, or roofing.

The term 'comprising' as used in this specification and claims means 'consisting at least in part of', that is to say when interpreting statements in this specification and claims which include that term, the features, prefaced by that term in each statement, all need to be present but other features can also be present.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

By way of example, the fixing system of the present invention will be described with reference to cladding boards of the weatherboard type. The weatherboards are arranged to be installed on framing or walls of a building in a partially overlapping relationship and are preferably provided with grooves on the front and rear faces that, when installed, co-operate to form an anti-capillary channel in the overlapping region of two adjacent weatherboards. It will be appreciated that there are many different weatherboard or cladding board designs that could provide for the overlapping relationship and the channel, and these alternative designs are all intended to be included within the scope of the present invention. Further, the fixing system will work with boards that are not designed to form anti-capillary channels.

In general, the present invention relates to a concealed fixing system for securing cladding boards to the framing or walls of a building. The fixing system is entirely concealed when the boards are installed. The fixing system comprises rows of spaced apart fixing devices supported, directly or indirectly, by the framing or wall, each row of fixing devices being arranged to support a board or row of boards via engagement into a complementary recess provided in the ear face of each board. The fixing system preferably also utilises a number of fixing components that extend through the front face of each board along an upper edge of the board in the overlapping region between adjacent boards and into the framing to secure the boards to the framing. The fixing devices can be provided on cavity battens that are secured to the framing of the building or they may be directly connected to the framing.

Figure 1:
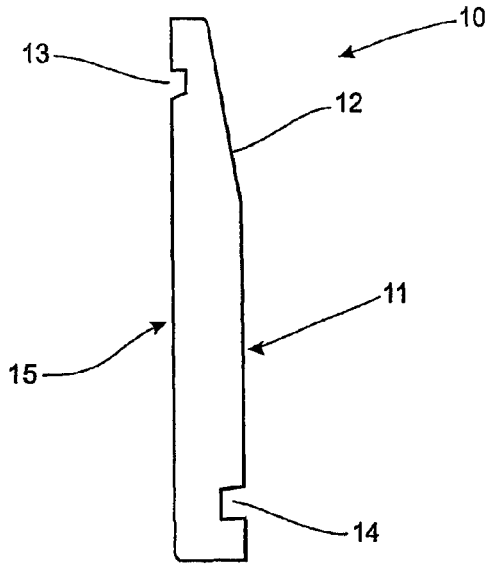
FIGURE 1 (Prior Art)
FIG. 1 shows a cross-sectional view of a prior art weatherboard design.
Figure 2:
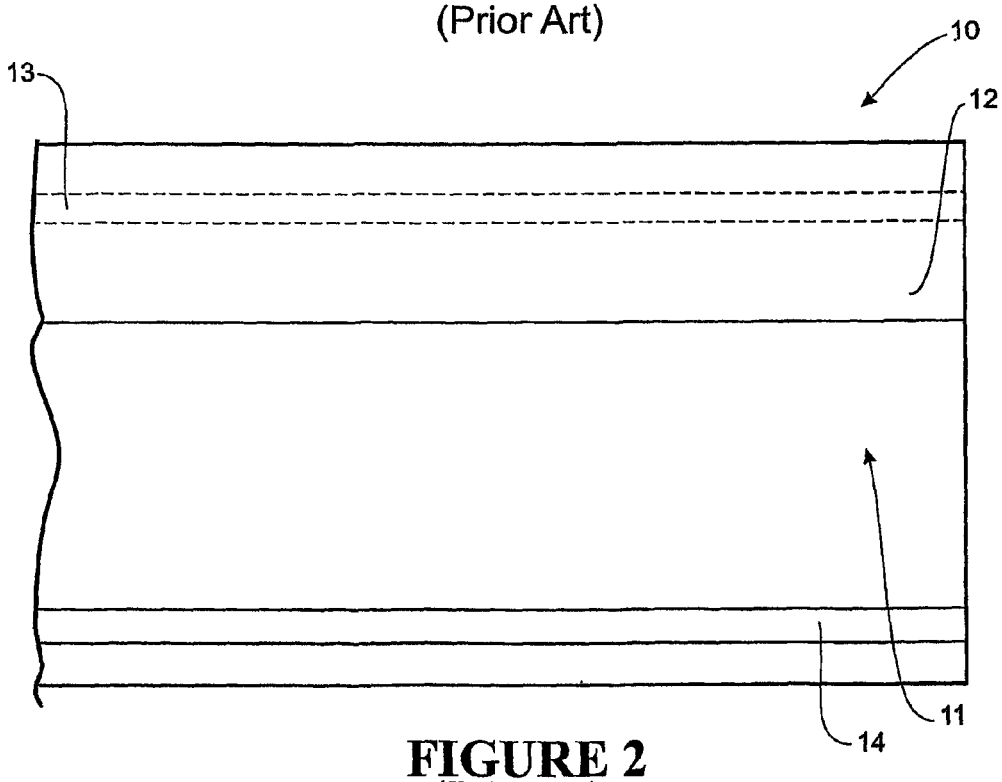
FIGURE 2 (Prior Art)
FIG. 2 shows a front view of the prior art weatherboard design of FIG. 1.
Figure 3:
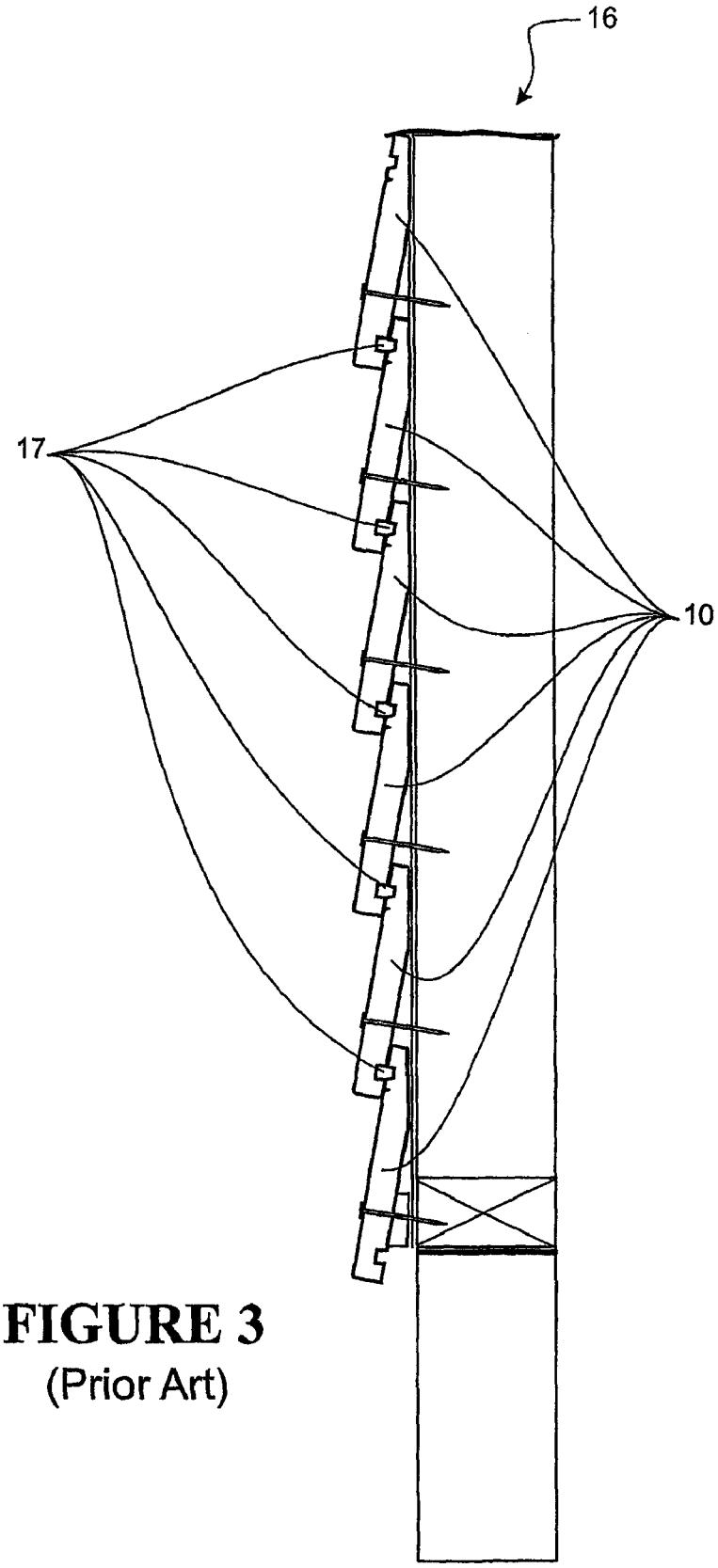
FIGURE 3 (Prior Art)
FIG. 3 shows a cross-sectional view of a series of the prior art weatherboards of FIGS. 1 and 2 installed on the framing of a building.
Figure 4:
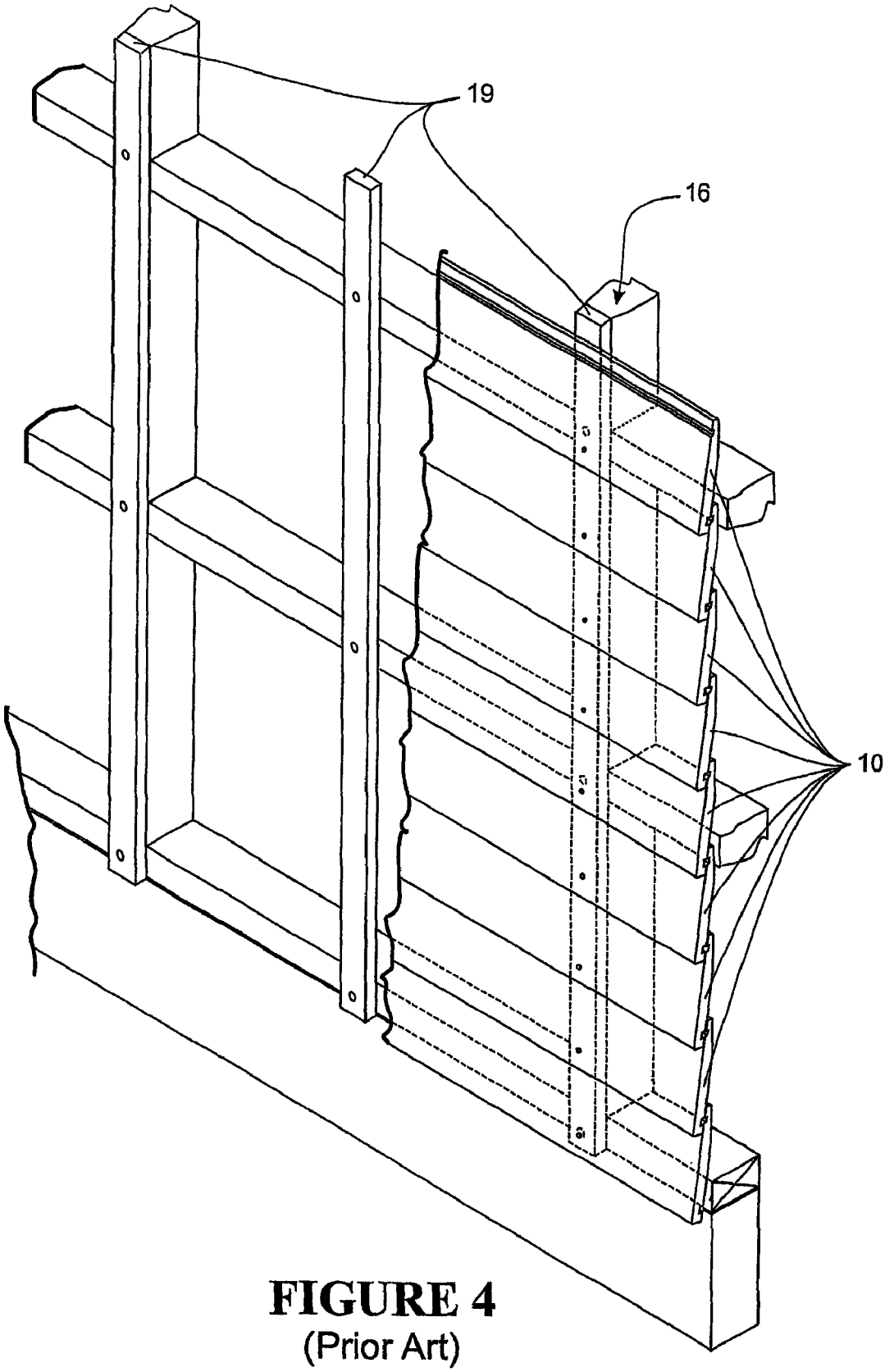
FIGURE 4 (Prior Art)
FIG. 4 shows a perspective view of a prior art weatherboard cladding system that utilises cavity battens in between the framing and weatherboards.
Figure 5:
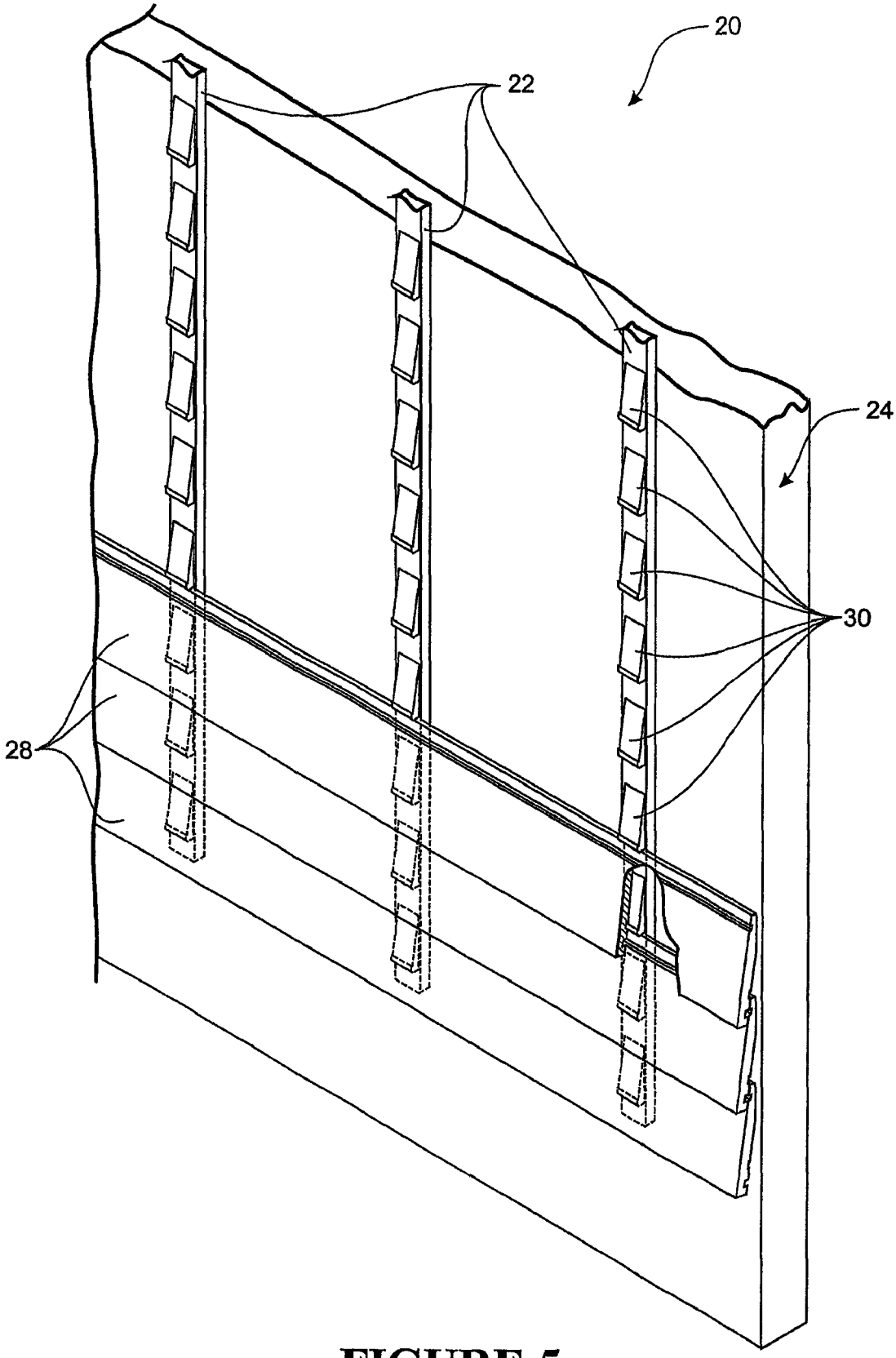
FIG. 5 shows a perspective view of a first preferred form of the fixing system of the present invention for securing weatherboards to a wall that utilises cavity battens with wedge type fixing devices.
Figure 6:
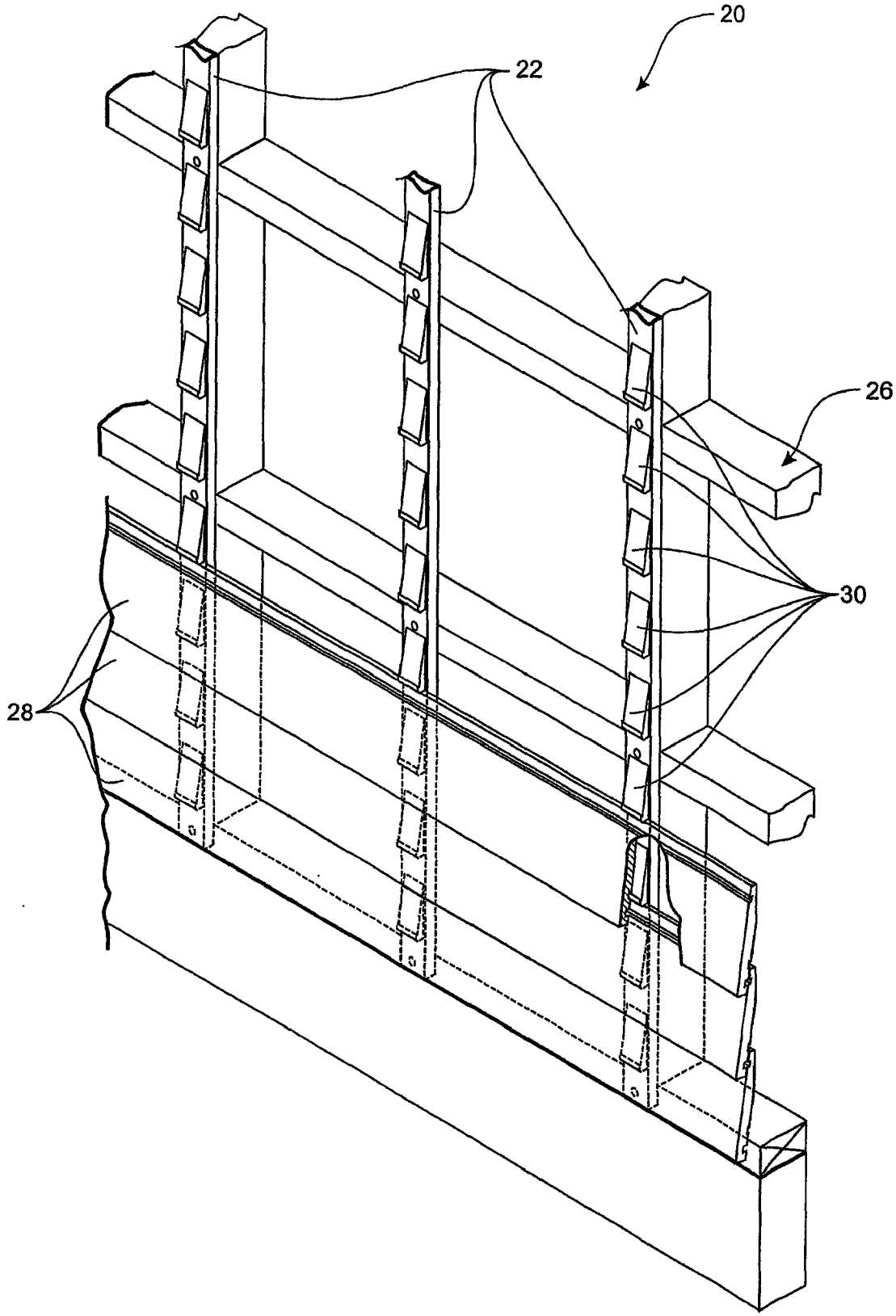
FIG. 6 shows the first preferred form of the fixing system of FIG. 5, except the cavity battens are attached to framing.

Referring to FIGS. 5-8*b*, a first preferred form of the fixing system of the invention will be described by way of example. Referring to FIGS. 5 and 6, the first preferred form of the fixing system 20 comprises a number of elongate cavity battens 22 that are attached or secured to the exterior surface of a wall 24 (FIG. 5) or framing 26 (FIG. 6) upon which a number of cladding boards 28 are installed in an overlapping relationship. The cavity battens 22 may be attached or secured to the wall 24 or framing 26 via fixing components such as nails or screws, or adhesive, or any other fixing means. The battens 22 are preferably installed in a vertical orientation and are spaced apart along the wall 24 or framing 26. They are also preferably aligned to form rows of fixing devices 30.

Each cavity batten 22 is provided with a number of fixing devices 30 spaced apart along its length. The fixing devices 30 include an engaging portion that is shaped to engage with or into a section of a complementary recess provided in and along the rear face of a board. The cavity battens 22 are arranged such that, when installed, the fixing devices 30 form rows, each row of fixing devices 30 being arranged to engage into a board or row of boards to hold the board or boards in place against the battens and/or framing. In particular, a number of fixing devices 30 of a row are arranged to co-operate together to engage in sections of the complementary recess of a board to hold the board in place against the wall 24 or framing 26.

Figure 7:
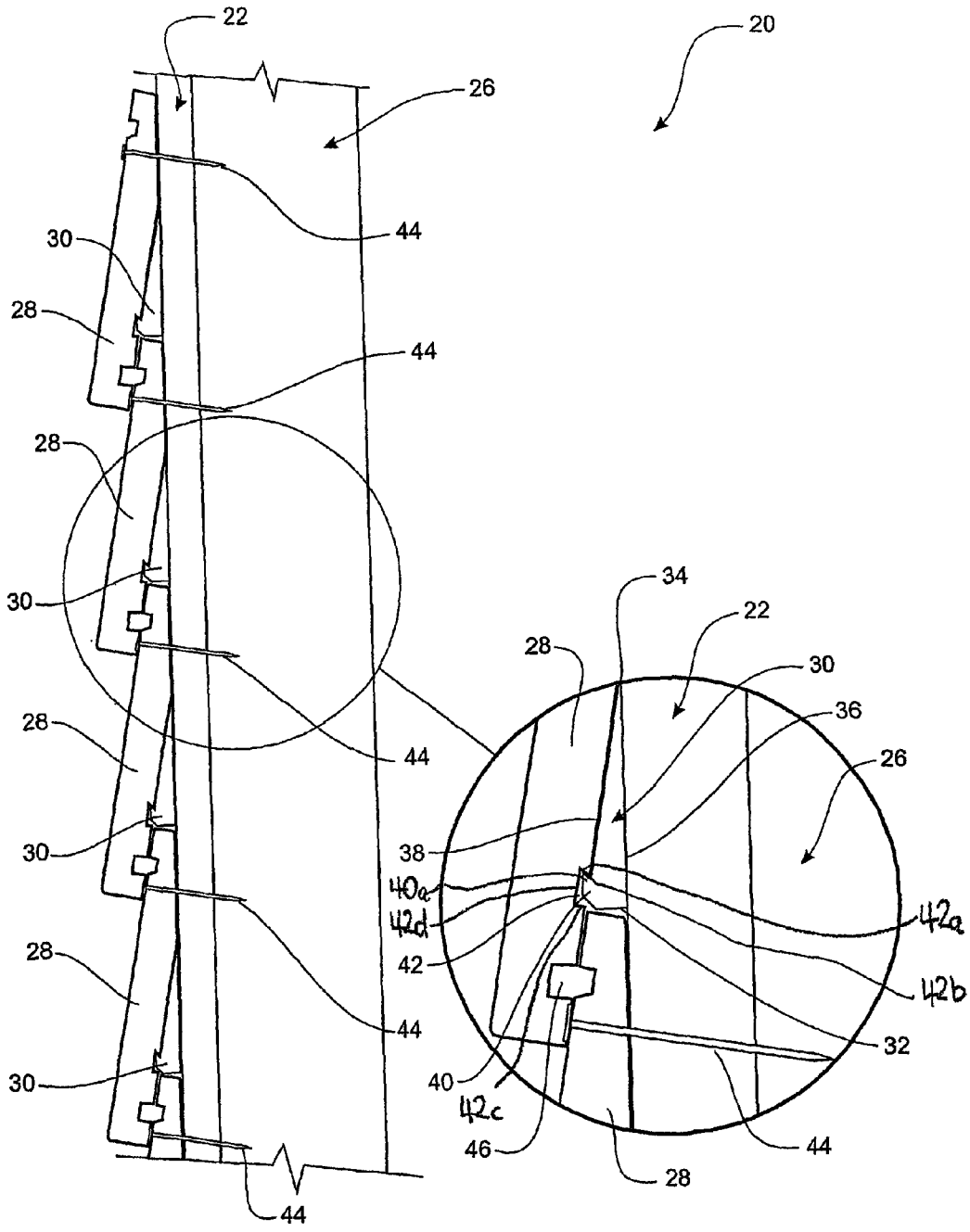
FIG. 7 shows a cross-sectional view of the first preferred form of the fixing system shown in FIG. 6.

Referring to FIG. 7, the fixing devices 30 and their relationship with the recesses of the boards will be described in more detail. The fixing devices 30 of the first preferred form of the fixing system are of a wedge type. In particular, they preferably have a cross-sectional profile that is substantially wedge-shaped with a base end 32 that tapers into a pointed top-end 34. More specifically, the cross-sectional profile of the fixing device 30 comprises a flat rear face 36 and an inclined front face 38 which meet at the pointed top-end or edge 34. In the preferred form, the front face 38 of the fixing device 30 is arranged to abut a rear face of a board 28. Protruding from the front face 38 toward the base end 32 is an engaging or engagement portion 40 that is shaped to securely engage or co-operate with a complementary recess 42 provided in and along the rear face of a board 28. In particular, the engaging portion 40 may be shaped such that it hooks into the recess 42 of the board to thereby support the weight of the board and hold it in place against the cavity battens 22 and framing 26. In the preferred form, engagement portion 40 includes a tapered protrusion 40*a*, the end point of which is arranged to extend upward and outward at an angle from the front face of the fixing device 30.

In the preferred form, the recesses 42 of the boards 28 axe preferably provided with a complementary inclined or angled surface 42*a* for receiving the tapered protrusion 40*a* of the fixing device in a hook-like engagement relationship to enable boards to be supported on the framing. With reference to FIG. 7, the recess 42 of the board 28 may, for example, have a cross-sectional profile that comprises a lower surface 42*c* that extends substantially perpendicularly into the board from and relative to the rear face of the board, and then a back surface 42*d* extending upwardly from the lower surface. The inclined upper surface 42*a* may then extending downwardly from the top of the back surface 42*d* back toward the rear face of the board 28 to complete the recess. In the preferred form, the angled upper surface 42*a* and rear face together form a tapered upper edge 42*b* that points downwardly and outwardly relative to the rear face for engaging in a hook-like engagement relationship with the tapered protrusions 40*a* of the fixing devices.

The fixing system 20 further preferably comprises a number of fixing components 44 that extend through the front face of the boards 28 toward and along the upper edge of each board and into the cavity battens 22 and framing 26 to secure each board in place. It will be appreciated that a number of fixing components 44 may be provided along the length of each board at appropriate places. The fixing components 44 may be nails, screws, or the like, and are located in the overlapping region of two adjacent boards so that they are concealed. Preferably, the fixing components 44 are inserted below the anti-capillary channel 46 formed by the co-operating grooves of the overlapping boards 28. Alternatively the fixing components may be inserted above the channel 46 or they may be inserted anywhere in the overlapping region if the boards do not provide anti-capillary channels.

Figure 8A:
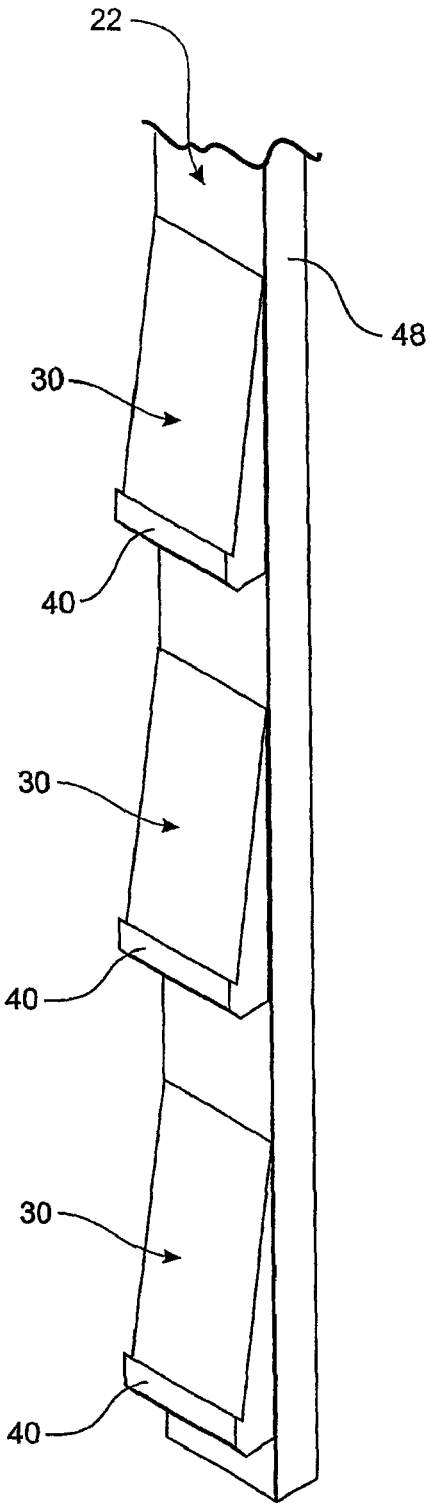
FIGS. 8*a* and 8*b* show perspective and plan views respectively of the cavity battens of the first preferred form of the fixing system of FIGS. 5-7.
Figure 8B:
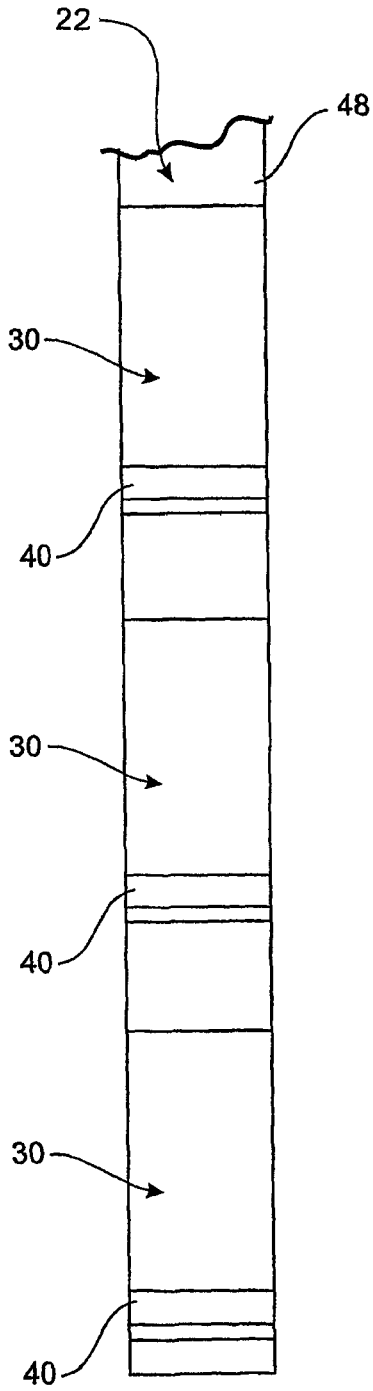

Referring to FIGS. 8*a* and 8*b*, a cavity batten 22 is shown in isolation and will be explained in more detail. Each cavity batten 22 comprises an elongate base member 48 having a number of fixing devices 30 spaced apart along its length. The fixing devices 30 are identical in profile and are spaced apart on the batten 22 by a uniform predetermined distance that corresponds to the dimension of the boards being installed and the desired overlap required for the boards. In particular, the predetermined spacing distance between the fixing devices is calculated based on the height of the boards 28 and a uniform desired board overlap distance to enable rows of fixing devices to be formed during installation of the battens, one row of fixing devices for each row of boards. It will be appreciated that the fixing devices may be integrally formed with the elongate base member 48. For example, the cavity batten may be formed from wood and may be profiled or cut to provide a plurality of fixing devices 30 on its front face.

Alternatively, it will be appreciated that the fixing devices 30 may be individually formed and cut and attached individually to the base member 48 of the cavity batten 22 via adhesives, nails, screws, or other fixing means. It will be appreciated that the cavity batten may be formed as one uniform integral component or by an interconnection of the base member 48 and a number of fixing devices 30. The battens may be formed from any suitable type of material, such as wood, plastic, metal, steel or any combination thereof. The battens may be any desired length as required.

Figure 9A:
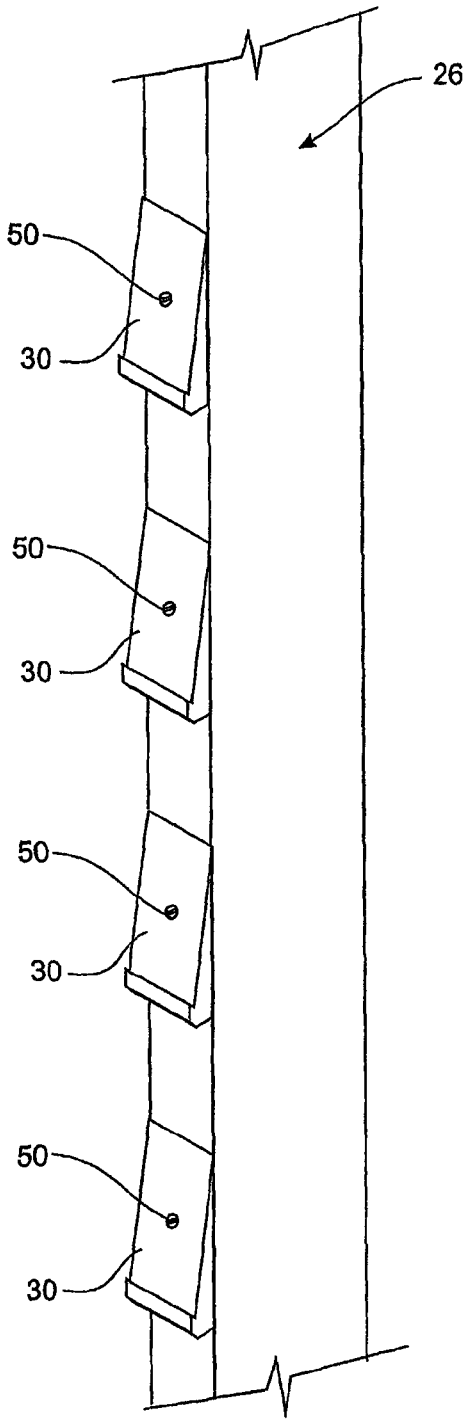
FIGS. 9*a* and 9*b* show perspective and cross-sectional views respectively of an alternative form of the first preferred form of fixing system in which individual fixing devices are directly connected to the framing without cavity battens.
Figure 9B:
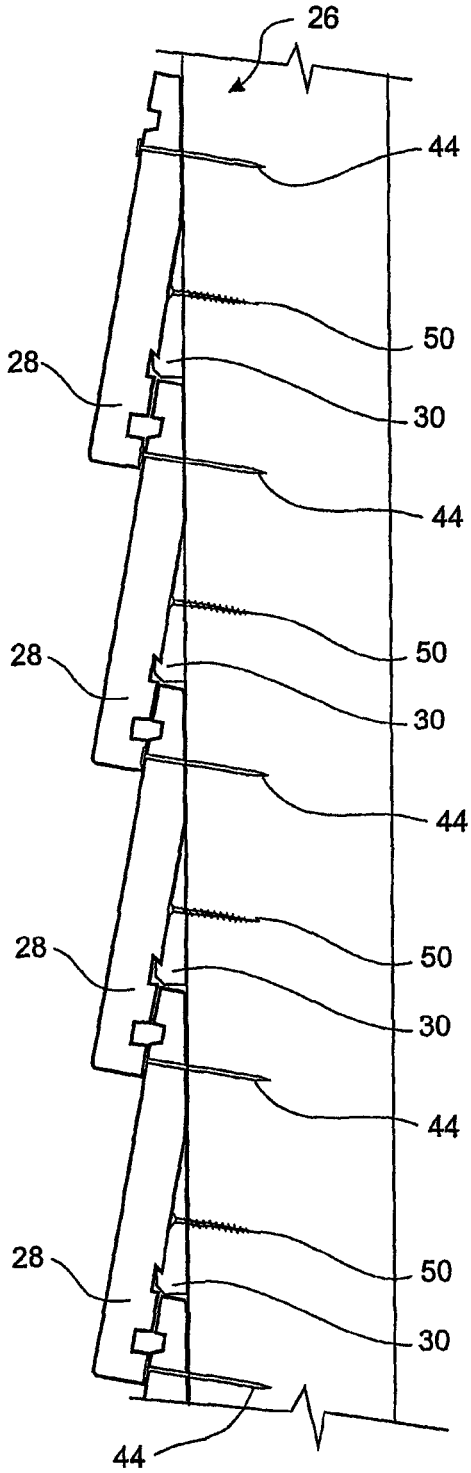

As mentioned, it is desirable to utilise cavity battens to provide cavities in between the cladding boards and framing for drainage purposes, especially when the cladding boards are likely to be exposed to particularly harsh weather conditions. However, an alternative to the first preferred form of the fixing system 20 may be employed that does not utilise cavity battens. In particular, the fixing devices 30 may be directly attached to the framing 26 of the building such that they are spaced apart vertically and horizontally on the face of framing to form rows, each row being arranged to receive and retain an individual cladding board or row of boards. For example, FIGS. 9*a* and 9*b* show an alternative form of the first preferred form of the fixing system 20 that does not utilise cavity battens. Rather, it utilises fixing devices 30 that are directly coupled or connected to the framing 26 with fixing components 50 such as screws, nails, or the like. FIG. 9*a* shows a single framing component 26, such as a stud or strut, with directly connected fixing devices 30 and FIG. 9*b* shows a number of cladding boards 28 installed onto the framing 26. Like FIG. 7, fixing components 44 are provided in the overlapping region extending through the front face of each board 28 and into the framing 26 to provide additional securement of the cladding boards to the framing.

Figure 9C:
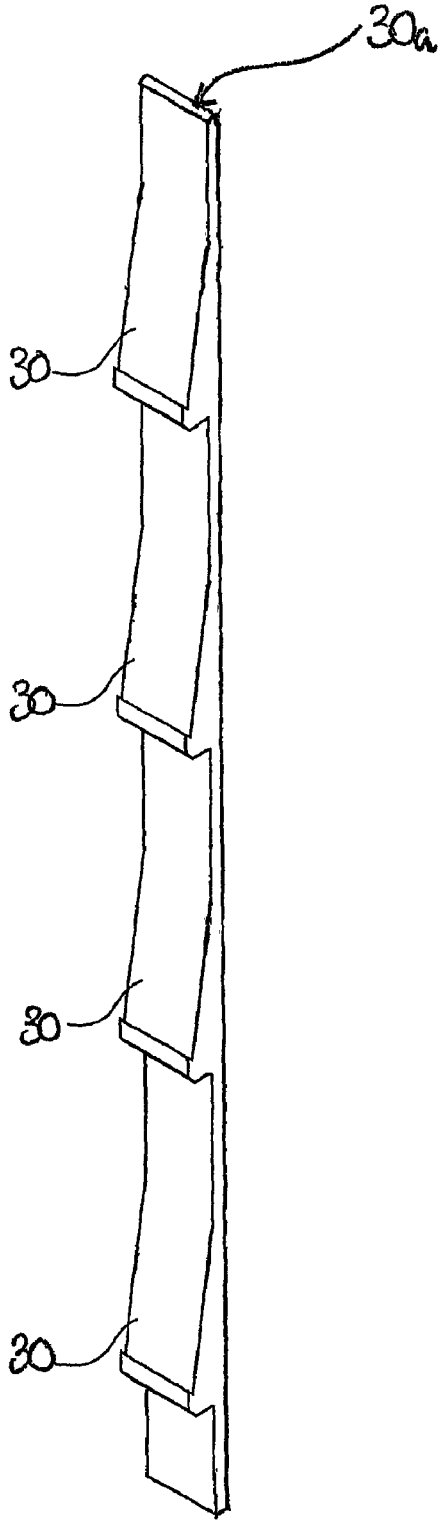
FIG. 9*c* shows a perspective view of another alternative form of the first preferred form of fixing system in which an integral strip of fixing devices is provided for connecting directly to the framing without cavity battens.

Another alternative form of the first preferred form of the fixing system 20 that can be used without cavity battens is shown in FIG. 9*c*. In this form, the fixing devices 30 may be formed in integral plates or fixing strips 30*a* of any desired length and from metal, steel, plastic, wood or any other suitable material. These strips 30*a* can be directly attached to the framing with nails, screws, staples, adhesive or any other fixing means to form the rows of fixing devices on the framing.

Figure 10A:
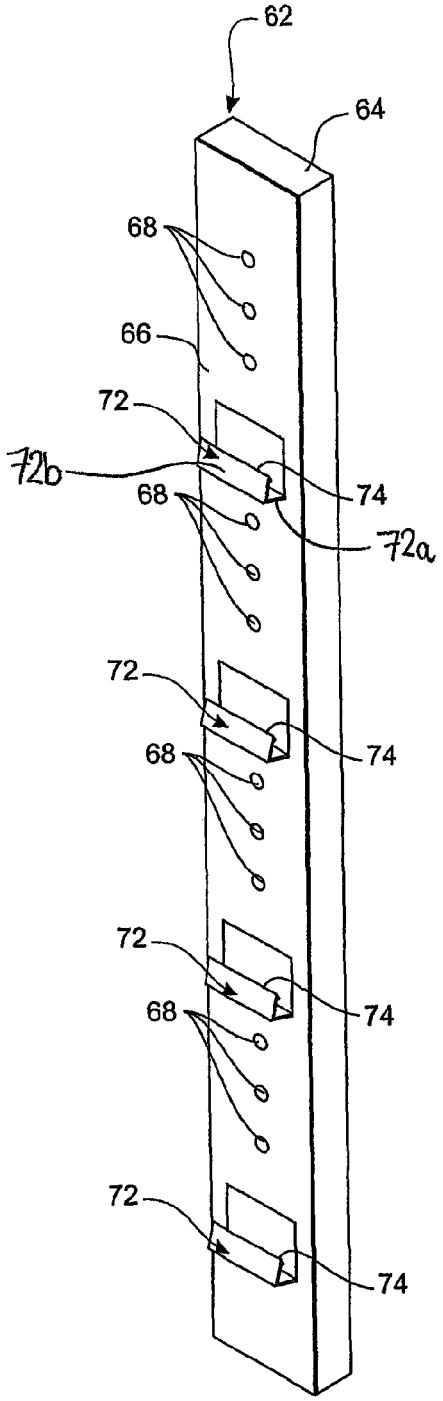
FIG. 10*a* shows a perspective view of cavity battens with bracket-type fixing devices that are utilised in a second preferred form of the fixing system of the present invention.
Figure 10B:
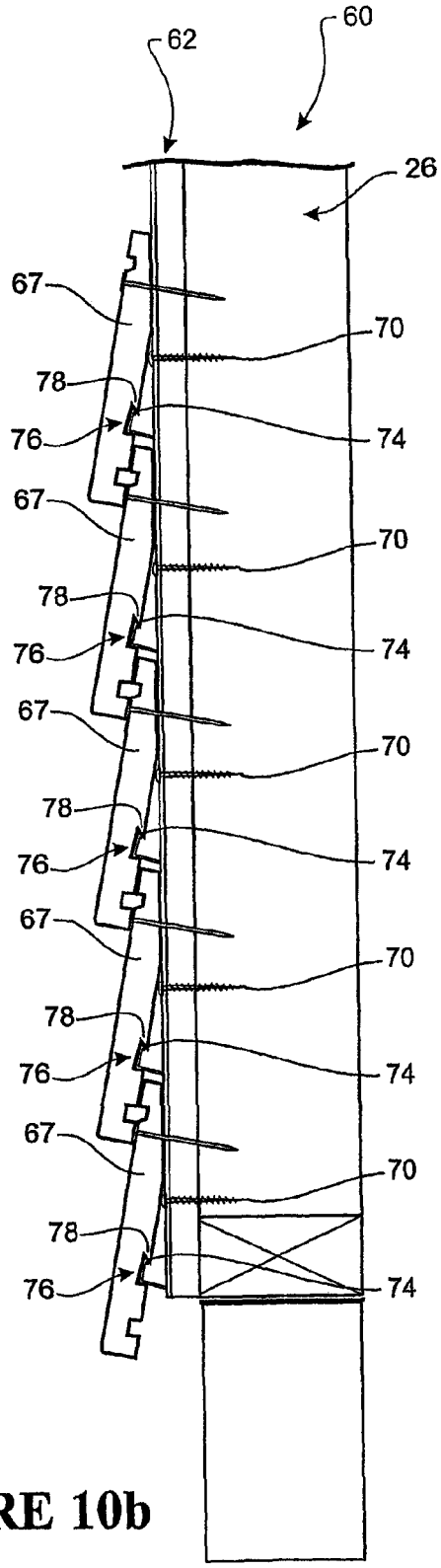
FIG. 10*b* shows a cross-sectional view of the second preferred form of the fixing system for securing weatherboards to framing.

Referring to FIGS. 10*a* and 10*b*, a second preferred form of the fixing system of the present invention will be described. The second preferred form of the fixing system 60 is substantially similar to that of the first preferred form, but differs in that the fixing devices are bracket-type components rather than wedge-type components.

Referring to FIG. 10*a*, the cavity battens 62 of the fixing system 60 comprise an elongate base member 64 on to which is attached a top plate 66. The top plate 66 is provided with a number of connection apertures 68 through which fixing components such as screws 70, nails, or the like may extend to fix the cavity batten 62 to the framing 26 as shown in FIG. 10*b*. It will be appreciated that screws, nails, or other fixing components may extend through these apertures 68 to couple the top plate 66 to the base member 64 or alternatively the top plate may be connected to the base member 64 via adhesives such as glue or the like.

In the preferred form, the top plate 66 is punched along its length to form bracket-type fixing devices 72 that are shaped to engage with complementary recesses 76 in the rear faces of cladding boards 67 as shown in FIG. 10*b*. In particular, the bracket-type fixing devices 72 may have a substantially L-shaped cross-sectional profile. For example, the fixing devices 72 may comprise a base portion 72*a* that is arranged to extend outwardly relative to the batten 62 and an integral engagement portion 72*b* that extends upwardly from the base portion 72*a* and which terminates with a hooked-end edge 74 that bends toward the batten. In operation, the engagement portion 72*b* and hooked-end edge 74 are arranged to engage with a complementary inclined surface 78 of the recess 76 of the cladding board 67 in a hook-like engagement relationship to hold the board in place on the batten and framing.

Other than the bracket-type nature of the fixing devices 72, the fixing system 60 operates in a similar manner to that described in respect of the first preferred form of the fixing system 20. For example, concealed fixing components such as nails, screws, or the like are provided in the overlapping region of the cladding boards 67 to secure them to the battens 62 and framing 26 for additional support.

It will be appreciated that the bracket-type fixing devices 72 may be formed in other ways and do not necessarily have to be integrally provided by a single top plate 66. For example, individual bracket-type fixing devices may be individually attached or secured along the length of the base member 64 of the cavity batten 62 at spaced apart intervals. The cavity batten 62 may be formed from wood, plastic, metal or a combination thereof. For example, it may have a wooden base member 64 and a metal top plate 66 having metal integral fixing devices 72 or alternatively the top plate 66 may be plastic. The base member 64 does not necessarily have to be wood and could also be plastic or metal.

Figure 11A:
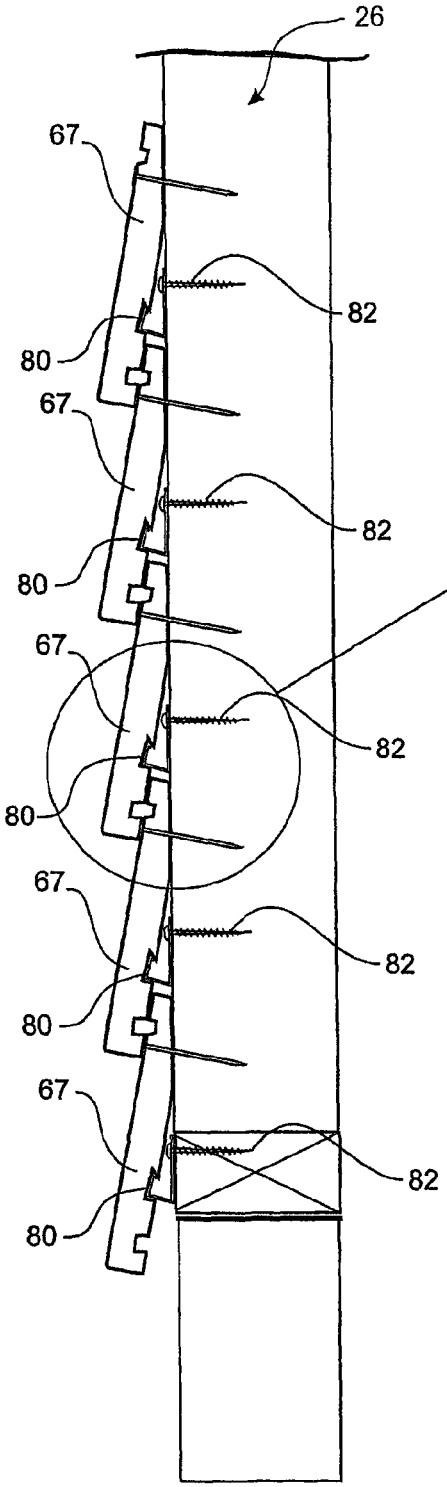
FIGS. 11*a*-11*c* show an alternative form of the second preferred form of the fixing system in which the fixing devices are directly connected to the framing without cavity battens.
Figure 11B:
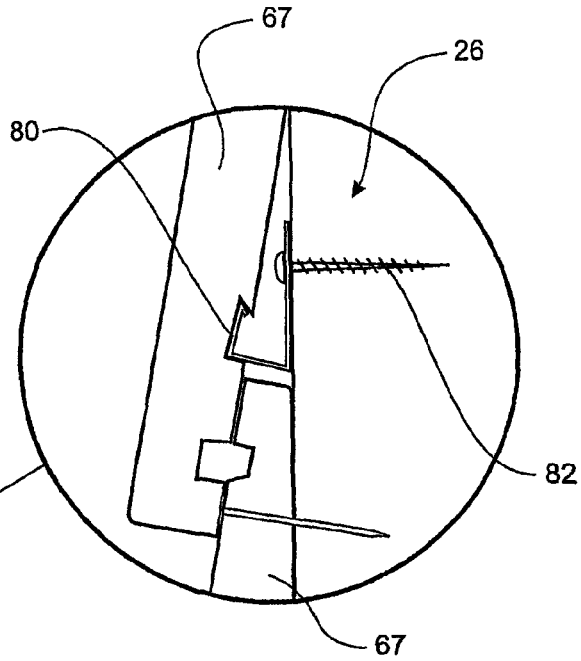
Figure 11C:
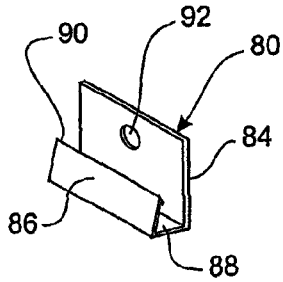

In an alternative form of the fixing system 60, the bracket-type fixing devices may be provided on the framing without cavity battens. For example, individual bracket-type fixing devices 80 may be secured directly to the framing in rows via thing components 82, such as screws, nails, or the like as shown in FIGS. 11*a*-11*c*.

The individual fixing devices 80 of the bracket-type will be explained in more detail with reference to FIG. 11*c*. In the preferred form, the fixing devices 80 have a substantially U-shaped cross-sectional profile that is formed by shaping or bending a flat metal component. For example, the fixing devices 80 comprises a rear portion 84 and a front engagement portion 86 that are integrally joined at the bottom by a base portion 88 to create a substantially U-shaped bracket. In the preferred form, the front engagement portion 86 terminates with a hooked-end top edge 90 that bends toward rear portion 84. In operation, the front engagement portion 86 and hooked edge 90 are arranged to securely engage with a section of the recess and its inclined upper surface of a cladding board as previously described in a hook-like engagement relationship. The rear portion 84 is provided with an aperture 92 through which a fixing component 82, such as a screw, nail, or the like, may extend to secure or attach the fixing device to framing or the like.

Figure 12:
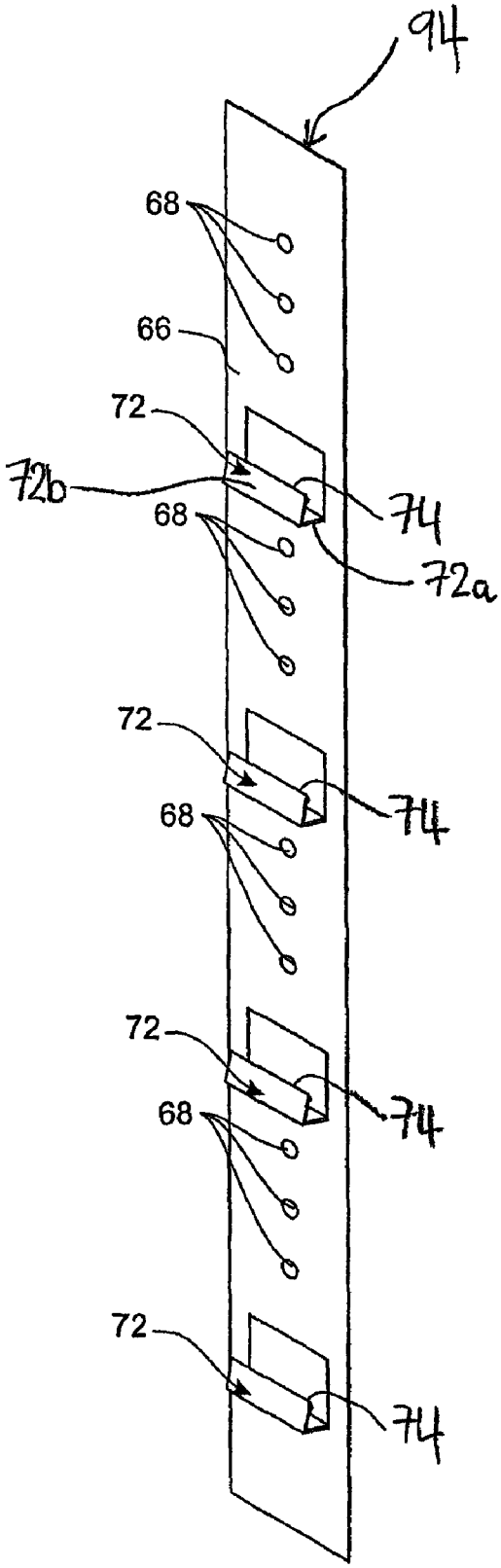
FIG. 12 shows a perspective view of another alternative form of the second preferred form of the fixing system in which an integral strip of fixing devices is provided for connecting directly to the framing without cavity battens.

In another alternative form of the fixing system 60, the bracket-type fixing devices may be formed in integral plates or fixing strips 94 as shown in FIG. 12. These strips 94 can be directly attached to the framing with nails, screws, staples, adhesive or any other fixing means to form the rows of fixing devices on the framing without using cavity battens. The strips 94 may be any desired length and may be formed from metal, steel, plastic, wood or any other suitable material. By way of example, the strips 94 may be essentially the same as the top plates 66 described with reference to FIGS. 10*a* and 10*b*, and like features have like reference numerals in FIG. 12.

Installation of cladding boards utilising the fixing system of the present invention will now be described. Firstly, the cavity batten based fixing systems described with reference to FIGS. 5, 6, 7, 8*a*, 8*b*, 10*a* and 10*b* will be described. Referring to FIG. 6 by way of example, installation involves firstly fixing a number of cavity battens 22 to the framing 26 of the building in a vertical orientation at spaced apart intervals. These intervals can be lengthened or shortened as desired and they do not necessarily have to be uniform. The cavity battens 22 are installed such that that fixing devices 30 provided on each cavity batten are aligned with the fixing devices of the other cavity battens to form rows of fixing devices. Installation then involves fixing cladding boards 28 to the cavity battens so that the boards have an overlapping relationship with respect to each other. For example, a top portion of a lower board should be covered by a lower portion of the next highest board, with all boards preferably in a parallel configuration with even overlap.

Typically, the boards 28 are fixed to cavity battens 22 one at a time beginning at the bottom of the framing 26 where the cladding is to start. Typically, the lower-most board is installed first by being engaged against the lower-most row of fixing devices such that a number of the fixing devices of that row engage securely in sections of the complementary recess in the rear face of the board. With the board 28 held in place against the cavity battens 22 by a number of fixing devices, a number of fixing components, such as nails, screws, staples, or the like, can be inserted or driven through the front face and toward the top edge, and preferably under the anti-capillary groove, of the board 28 and into the battens 22 and/or framing 26 to secure the board in place. With the lower-most board in place, the next board may be positioned against the cavity battens such that its rear face recess engages with a number of fixing devices of the next row and it may then also be nailed in place. The vertical spacing between the rows of fixing devices is preferably uniform and predetermined to ensure an even overlap of boards up the framing. The overlap also conceals the nails inserted below the anti-capillary channel. Each subsequent board is installed in a similar manner until the cavity battens and/or framing of the building is fully covered.

Installation of cladding boards utilising the fixing system described with respect to FIGS. 9*a*, 9*b* and 11*a*-11*c* is similar but more labour intensive. In particular, rather than simply installing a number of cavity battens upon the framing in a spaced apart manner, individual fixing devices, whether wedge-type (FIGS. 9*a* and 9*b*) or bracket-type (FIGS. 11*a*-11*c*), must be fixed to the framing in a spaced apart manner vertically and horizontally to create aligned rows of fixing devices, each row being arranged to support a board or row of boards.

Installation of the cladding boards utilising the fixing system described with respect to FIGS. 9*c* and 12 is similar to that described with respect to the cavity batten based fixing systems. In particular, the integral fixing strips 30*a* (wedge-type—FIG. 9*c*) or 94 (bracket-type—FIG. 12) of fixing devices are attached directly to the framing and aligned on the framing in a similar manner to the cavity battens 22 to form rows of fixing devices.

It will be appreciated that the fixing devices may be formed from various materials and that there are various alternative complementary shapes of fixing devices and cladding board recesses that could be utilised to engage with each other to hold cladding boards in place. The wedge-type and bracket-type fixing devices described are provided by way of example only.

It will be appreciated that the vertical and horizontal spacing between fixing devices, whether installed via cavity battens or directly to framing, may be varied as desired to accommodate different framing structures, cladding board sizes and the like. Preferably, the vertical spacing intervals between fixing devices is uniform to provide an even overlap of boards up the framing. The horizontal spacing intervals can be varied according to the desired level of structural integrity required.

The fixing system of the present invention provides greater stability in the construction of cladding board buildings and houses. The fixing devices of the fixing system are designed to hold boards in place, with nails or the like providing additional securement at intervals through the unexposed surface of the boards in the overlapping region. The fixing system provides greater stability of boards and provides greater resistance against the elements as it is an entirely concealed fixing system. The concealed nature of the fixing system also provides an aesthetic advantage in that there is no visible nailing. Also, boards can be pre-painted prior to installation on the framing and this may provide cost savings from an installation viewpoint. Further, the cavity batten based fixing system provides a means of enhancing the durability and life of cladding via increased drainage.

The fixing system has been described in the context of cladding the framing of a building, but it will be appreciated that the system can also be applied to roofing, fencing, and screens, whether the framing is timber or metal. It will also be appreciated that the boards of the cladding system can be installed horizontally, vertically or on an angle.

The foregoing description of the invention includes preferred forms thereof. Modifications may be made thereto without departing from the scope of the invention as defined by the accompany claims.

The invention claimed is:

1. Cladded framing comprising:

vertically extending framing onto which cladding boards are mounted;

a plurality of fixing devices mounted to the framing, the fixing devices being spaced apart vertically and horizontally relative to one another and aligned in horizontal rows extending up the framing and each fixing device having an engagement portion for engaging with and supporting cladding boards, the engagement portion comprising an engagement surface that is arranged to extend upward and outward at an angle relative to the vertically extending framing;

rows of partially overlapping elongate cladding boards covering the framing, and each cladding board being defined along the length of the cladding board by a front face and a rear face that extend between upper and lower surfaces of the cladding board, wherein adjacent rows of cladding boards overlap in respective overlapping regions such that a top portion of each cladding board is covered by a lower portion of a cladding board from an upper adjacent row of cladding boards, and a recess being provided in and along the rear surface of each cladding board into which the engagement portions of a number of fixing devices of a row engage to support the cladding board on the framing such that each row of cladding boards is supported by a respective row of fixing devices and wherein each recess of the cladding boards comprises a complementary angled engagement surface that extends downwardly at an angle toward the vertically extending framing and which abuts and rests upon the engagement surfaces of the engagement portions of its respective row of fixing devices in a hook-like engagement relationship to support the cladding boards in place on the framing; and a plurality of fixing components extending through the top portion of the front face of each cladding board within its overlapping region and into the framing to secure each cladding board to the framing in co-operation with the fixing devices, and such that the fixing components associated with each cladding board are concealed from visibility underneath lower portions of overlapping cladding boards from an upper adjacent row of cladding boards.

2. Cladded framing according to claim 1 wherein the fixing devices are provided in integral strips that are secured to the framing for receiving the boards, each strip being provided with a number of integral fixing devices spaced apart along its length, and the strips being spaced apart and aligned on the framing in a vertical orientation relative to each other to provide the horizontal rows of fixing devices on the framing for supporting rows of cladding boards.

3. Cladded framing according to claim 2 wherein the fixing devices are spaced apart along the length of the strips by a uniform predetermined distance that is calculated based on the height of the cladding boards between their upper and lower surfaces and a uniform desired board overlap distance defining the overlapping region so that each row of boards has a corresponding row of fixing devices.

4. Cladded framing according to claim 1 wherein the fixing devices are individually attached directly to the framing in a spaced apart arrangement vertically and horizontally with respect to each other on the framing to form the horizontal rows of fixing devices on the framing for supporting rows of cladding boards.

5. Cladded framing according to claim 1 wherein the fixing devices are provided on battens that are secured to the framing for receiving the boards, each batten being provided with a number of fixing devices spaced apart along its length, and the battens being spaced apart and aligned on the framing in a vertical orientation relative to each other to provide the horizontal rows of fixing devices on the framing for supporting rows of cladding boards.

6. Cladded framing according to claim 5 wherein the fixing devices are spaced apart along the length of the battens by a uniform predetermined distance that is calculated based on the height of the cladding boards between their upper and lower surfaces and a uniform desired board overlap distance defining the overlapping region so that each row of boards has a corresponding row of fixing devices.

7. Cladded framing according to claim 5 wherein the fixing devices are integrally formed with the battens.

8. Cladded framing according to claim 5 wherein the fixing devices are individually attached directly to the battens.

9. Cladded framing according to claim 5 wherein the fixing devices are integrally formed in integral strips that are fixed to the battens.

10. Cladded framing according to claim 5 wherein the battens each comprise an elongate base member that is attached along its length to a corresponding top plate, the top plate being provided with a number of integral fixing devices spaced apart along its length.

11. Cladded framing according to claim 1 wherein each fixing device comprises a wedge-shaped component.

12. Cladded framing according to claim 11 wherein each fixing device comprises a wedge-shaped component having a substantially wedge-shaped cross-sectional profile defined by a lower base end from which a rear face and a front face upwardly extend, the front face being angled relative to the rear face such that the front and rear faces meet to form a pointed top-end opposite and above the base end and wherein the front face is designed to abut a rear face of the cladding board and wherein the engagement portion of the fixing device protrudes from the front face of the wedge-shaped component at a location on the front face which is at or toward the base end of the wedge-shaped component, and wherein the rear face of the fixing device faces the framing.

13. Cladded framing according to claim 12 wherein the engagement portion of each fixing device is a tapered protrusion which comprises the engagement surface.

14. Cladded framing according to claim 1 wherein each fixing device comprises a bracket-type component.

15. Cladded framing according to claim 14 wherein the bracket-type component of each fixing device has a substantially L-shaped cross-sectional profile formed by a base portion that is arranged to extend outwardly relative to the framing and wherein the engagement portion of the fixing device extends upwardly from the base portion and terminates with a hooked-end edge that bends toward the framing, and which comprises the engagement surface.

16. Cladded framing according to claim 14 wherein the bracket-type component of each fixing device has a substantially U-shaped cross-sectional profile formed by: a rear portion being arranged for securing directly or indirectly to the framing; a base portion extending outwardly from the bottom of the rear portion; and wherein the engagement portion of the fixing device extends upwardly from the base portion and terminates with a hooked-end edge that bends toward the rear portion, and which comprises the engagement surface.

17. Cladded framing according to claim 15 wherein the portions of each fixing device are integrally formed with each other.

18. Cladded framing according to claim 1 wherein each cladding board is provided with grooves along its front and rear faces and is arranged to abut another cladding board in a partially overlapping relationship on the framing such that the grooves of the front and rear faces are aligned and co-operate to form a channel, the fixing components being arranged to extend through the top portion of the front face of each board and into the framing within the overlapping region of adjacent boards but under the respective channels to secure each board to the framing in co-operation with the fixing devices.

19. Cladded framing according to claim 1 wherein the fixing components are selected from the following: nails, screws, or staples.

20. A method of installing elongate cladding boards onto vertically extending framing of a building, each cladding board being defined along the length of the cladding board by a front face and a rear face that extend between upper and lower surfaces of the cladding board and with a recess being provided in and along the rear face of the cladding board and wherein the recess comprises an angled engagement surface that is arranged to extend downwardly toward the vertically extending framing when the cladding board is installed, the cladding boards being installed in a partially overlapping relationship such that adjacent cladding boards overlap in respective overlapping regions so that a top portion of each cladding board is covered by a lower portion of a cladding board from an upper adjacent row of cladding boards, the method comprising the steps of:

(a) securing horizontal rows of spaced-apart fixing devices to the framing, each row of fixing devices being arranged to support a cladding board or row of cladding boards and each fixing device having an engagement portion comprising an engagement surface that is arranged to extend upward and outward at an angle relative to the vertically extending framing when the fixing device is installed on the framing and which is arranged to abut with a section of the engagement surface of the recess of a cladding board in a hook-like engagement relationship to, in co-operation with a number of other fixing devices of that row also similarly abutting with a respective section of the recess, support the cladding board in place on the framing, the vertical distance between the rows of fixing devices determining the overlapping region between adjacent cladding boards of adjacent upper and lower rows of cladding boards;

(b) engaging a first cladding board or row of cladding boards with the lower-most row of fixing devices such that the engagement portions of a number of fixing devices of that row engage into the recesses of the rear face of the first cladding board or row of cladding boards to support and hold it in place such that at least a portion of the rear face of the cladding board abuts the framing;

(c) driving a number of fixing components through the top portion(s) of the front face of the first cladding board or row of cladding boards and into the framing along the length of the cladding board(s) within the overlapping region to secure the cladding board(s) in place on the framing; and (d) repeating steps (b) and (c) for second and subsequent boards in relation to the next rows of fixing devices to progressively clad the framing with cladding boards from the bottom up to form cladded framing according to claim 1.

21. A method according to claim 20 wherein step (a) comprises providing a number of battens, each batten having a number of fixing devices uniformly spaced apart along its length, and securing the battens in a spaced apart relationship and in a vertical orientation on the framing such that the fixing devices of the battens are aligned to form the rows of fixing devices.

22. A method according to claim 20 wherein step (a) comprises securing individual fixing components directly to the framing in a spaced apart arrangement vertically and horizontally with respect to each other to form the rows of fixing devices.

23. A method according to claim 20 wherein step (a) comprises providing a number of fixing strips, each fixing strip having a number of integral fixing devices spaced apart along its length, and securing the fixing strips in a spaced apart relationship and in a vertical orientation on the framing such that the fixing devices of the fixing strips are aligned to form the rows of fixing devices.

24. A method according to claim 20 wherein step (c) comprises driving fixing components selected from the following: nails, screws, or staples.

25. A fixing system according to claim 16 wherein the portions of each fixing device are integrally formed with each other.

26. Cladded framing according to claim 1 wherein the adjacent rows of cladding boards overlap in respective overlapping regions such that a top portion of the front face of each cladding board abuts a lower portion of a rear face of a cladding board from an upper adjacent row of cladding boards.

27. Cladded framing according to claim 1 wherein the recess of each cladding board has a cross-sectional profile comprising: a lower surface extending substantially perpendicularly into the board from and relative to the rear face of the board, a back surface extending upwardly from the lower surface, and wherein the engagement surface of the recess extends downwardly at an angle back to the rear face of the board from the back surface.

* * * * *